US010814153B1

(12) United States Patent
Wang

(10) Patent No.: US 10,814,153 B1
(45) Date of Patent: Oct. 27, 2020

(54) TRAMPOLINE

(71) Applicant: Dongguan Jianjia Industrial Co., Ltd., Dongguan, Guangdong (CN)

(72) Inventor: Jianwu Wang, Dongguan (CN)

(73) Assignee: Dongguan Jianjia Industrial Co., Ltd., Guangdong (CN)

( * ) Notice: Subject to any disclaimer, the term of this patent is extended or adjusted under 35 U.S.C. 154(b) by 0 days.

(21) Appl. No.: 16/304,711

(22) PCT Filed: Aug. 1, 2017

(86) PCT No.: PCT/CN2017/095360

§ 371 (c)(1),
(2) Date: Nov. 27, 2018

(87) PCT Pub. No.: WO2018/192134

PCT Pub. Date: Oct. 25, 2018

(30) Foreign Application Priority Data

Apr. 19, 2017 (CN) ..... 2017 1 0258894

(51) Int. Cl.
*A63B 5/11* (2006.01)
*A63B 71/00* (2006.01)

(52) U.S. Cl.
CPC ..... *A63B 5/11* (2013.01); *A63B 71/0054* (2013.01)

(58) Field of Classification Search
CPC .... A63B 5/16; A63B 5/12; A63B 5/08; A63B 21/026; A63B 5/11; A63B 26/00
See application file for complete search history.

(56) References Cited

U.S. PATENT DOCUMENTS 7,678,024 B2 * 3/2010 Alexander ..... A63B 5/11 482/27
7,708,667 B2 * 5/2010 Alexander ..... A63B 71/022 482/27
8,303,469 B2 * 11/2012 Alexander ..... A63B 5/11 482/27
8,974,350 B2 3/2015 Hsiang

FOREIGN PATENT DOCUMENTS

CN 201679853 U 12/2010
CN 205360365 U 7/2016
CN 205391545 U 7/2016
CN 205516152 U 8/2016
CN 106215365 A 12/2016

* cited by examiner

*Primary Examiner* — Nyca T Nguyen
*Assistant Examiner* — Andrew M Kobylarz
(74) *Attorney, Agent, or Firm* — Alan D. Kamrath; Karin L. Williams; Mayer & Williams PC

(57) ABSTRACT

A trampoline includes a chassis, a flexible cushion, a plurality of flexible rods, a protective net, a plurality of support rods, and a plurality of buckles. The plurality of flexible rods is spirally and detachably installed on the chassis. The buckles are provided on the flexible cushion. The top ends of the flexible rods are provided in the buckles. The support rods are detachably provided on the chassis. The bottom end of the protective net is fixed on the flexible cushion, and the top end of the protective net is provided at the top ends of the support rods. A bounce space is enclosed by the protective net and the flexible cushion.

10 Claims, 5 Drawing Sheets

TRAMPOLINE

BACKGROUND OF THE INVENTION

1. Fields of the Invention

The present invention relates to a recreational or competitive equipment, and more particularly, to a trampoline.

2. Descriptions of Related Art

Trampolines are used for recreational or competitive purposes and welcomed worldwide. The conventional trampolines generally include a frame with a net which is secured at the central portion of the frame, and the users bounce on the net. It is noted that the central portion of the net has better bouncing feature, and the bouncing feature gradually reduces at the positions close to the frame. In other words, the bouncing feature of the net is not even and balanced. Most of the frames are fixed and difficult to move and transport, and do not satisfy customers. Besides, the frames of the existed trampolines are made of hard material which may cause injuries to the users.

SUMMARY OF THE INVENTION

The present invention is intended to provide a trampoline that is designed to eliminate the drawbacks mentioned above.

In order to achieve the purposes mentioned above, the present invention provides the following technical solutions.

The present invention relates to a trampoline and comprises a chassis which has a base, and multiple support legs are connected to the base. The base has multiple installation holes and each installation hole has a positioning tube received therein. Multiple flexible rods are spiral rods and are detachably connected to the frame. Each flexible rod is a tubular body which has a bottom end thereof positioned to the tube corresponding thereto, and a ring is formed on a top end of the tubular body. Multiple buckles are connected to outer periphery of a flexible cushion, and each buckle has a room and a support portion. The room is defined in the underside of the buckle and the support portion is located in the room. The ring is located in the room, and the support portion extends through the ring. A protective net has a lower end thereof connected to the flexible cushion. Multiple support rods each have a top end and a lower end, wherein the lower end of each support rod is connected to the positioning tube corresponding thereto. A top end of the protective net is connected to the top ends of the support rods which expand the protective net. A bounce space is formed between the protective net and the flexible cushion.

Preferably, the base includes multiple installation tubes and multiple connection tubes, wherein the installation tubes are connected by the connection tubes to form the base.

Preferably, the installation tubes each are a curve tube and have multiple connection holes. The connection tubes are connected to the connection holes.

Preferably, the support legs each include a main frame which has two ends respectively connected to the installation tubes.

Preferably, the support legs each include a sub frame which has a lower end detachably connected to the main frame, and a top end of each sub frame supports a connection portion between the installation tubes.

Preferably, the flexible cushion has a flange extending outward from the outer periphery thereof, and multiple restriction holes are defined in the underside of the flange. The buckles are connected to the restriction holes.

Preferably, the buckles each have a hook formed on the underside thereof, and the hook is located outside of the room and faces a direction away from the room.

Preferably, the support rods each have a first rod, a second rod and a connection member. The second rod is detachably connected to the first rod by the connection member.

Preferably, multiple sleeves are located on the top of the protection net, respective tops of the second rods are installed in the sleeves.

Preferably, the positioning tubes each have a restriction portion and a movable engaging portion. The restriction portion is located outside of the base and the movable engaging portion is located in the connection hole.

Preferably, the chassis is made of Aluminum.

The trampoline of the present invention has a simple structure and can be assembled easily. The Aluminum and assembled chassis, and the flexible rods and the multiple support rods make the trampoline be easily stored and transported. The cost of transportation and the storage space are reduced. The rings on the flexible rods and the buckles on the flexible cushion make the assembly of the trampoline become simple and easy. The flexible rods have higher support and resilient features so as to increase the bouncing features evenly. The trampoline of the present invention is useful and acceptable by users.

DETAILED DESCRIPTION OF THE PREFERRED EMBODIMENT

The present invention will become more obvious from the following description when taken in connection with the accompanying drawings which show a preferred embodiment in accordance with the present invention.

Figure 1:
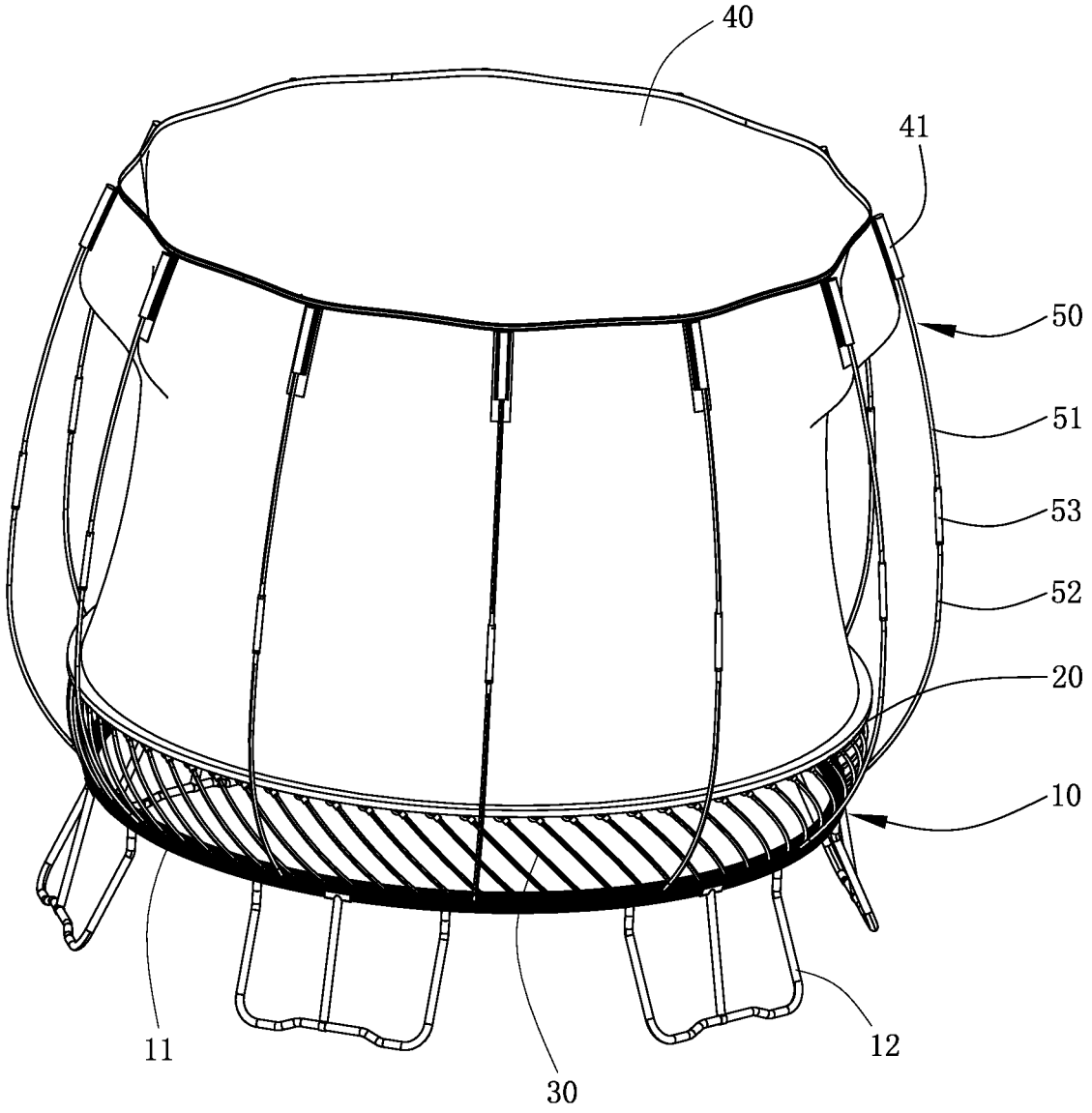
FIG. 1 is a perspective view to show the trampoline of the present invention.
Figure 2:
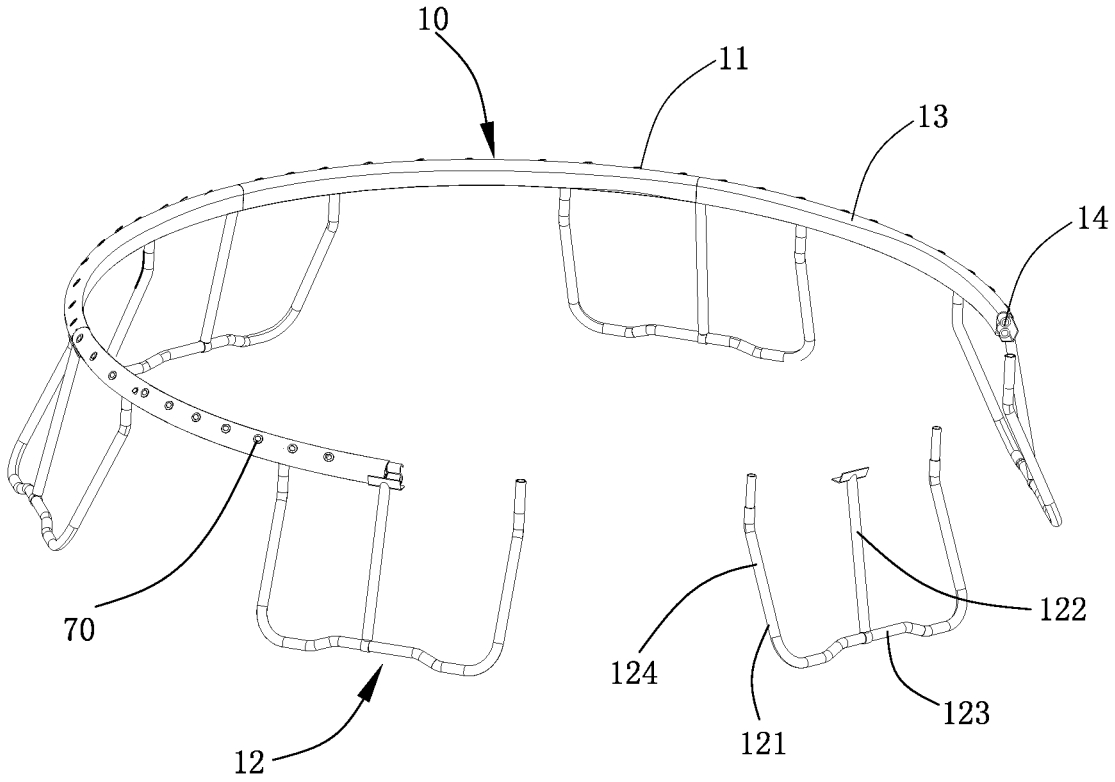
FIG. 2 shows the chassis of the trampoline of the present invention.
Figure 3:
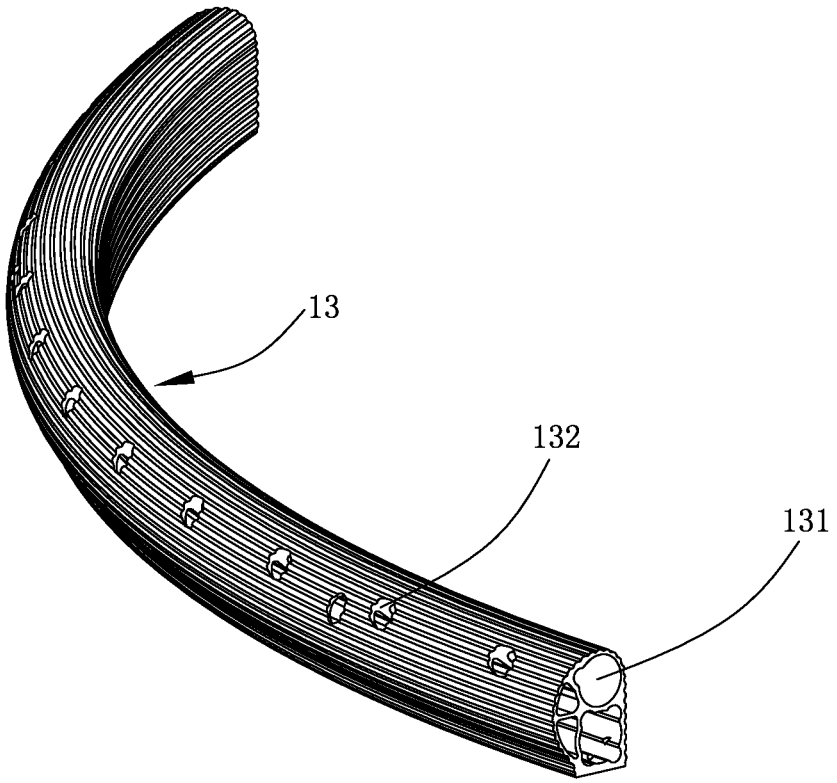
FIG. 3 shows the installation tube of the trampoline of the present invention.
Figure 4:
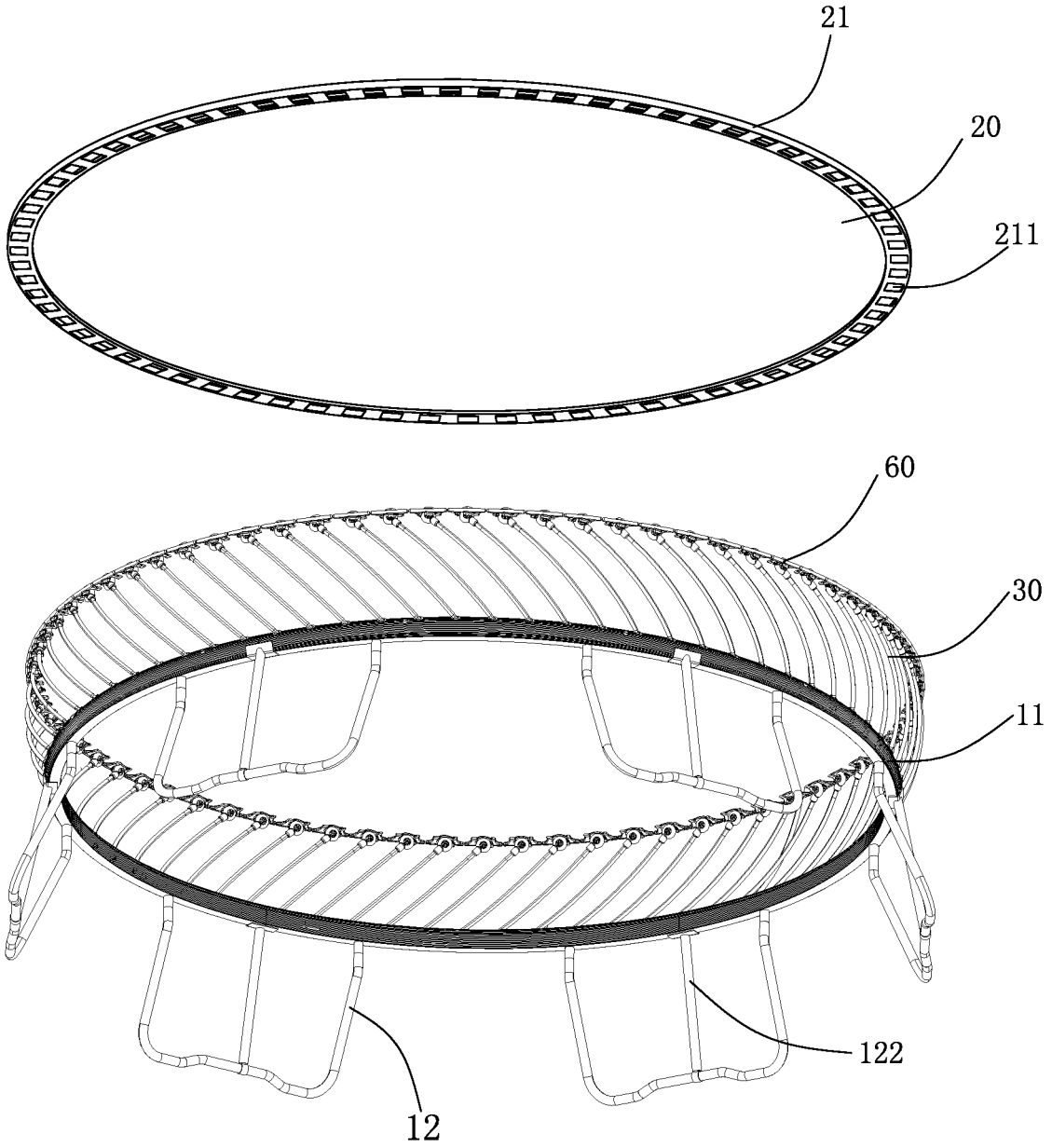
FIG. 4 shows the chassis, the flexible rods, the buckles and the flexible cushion of the trampoline of the present invention.
Figure 5:
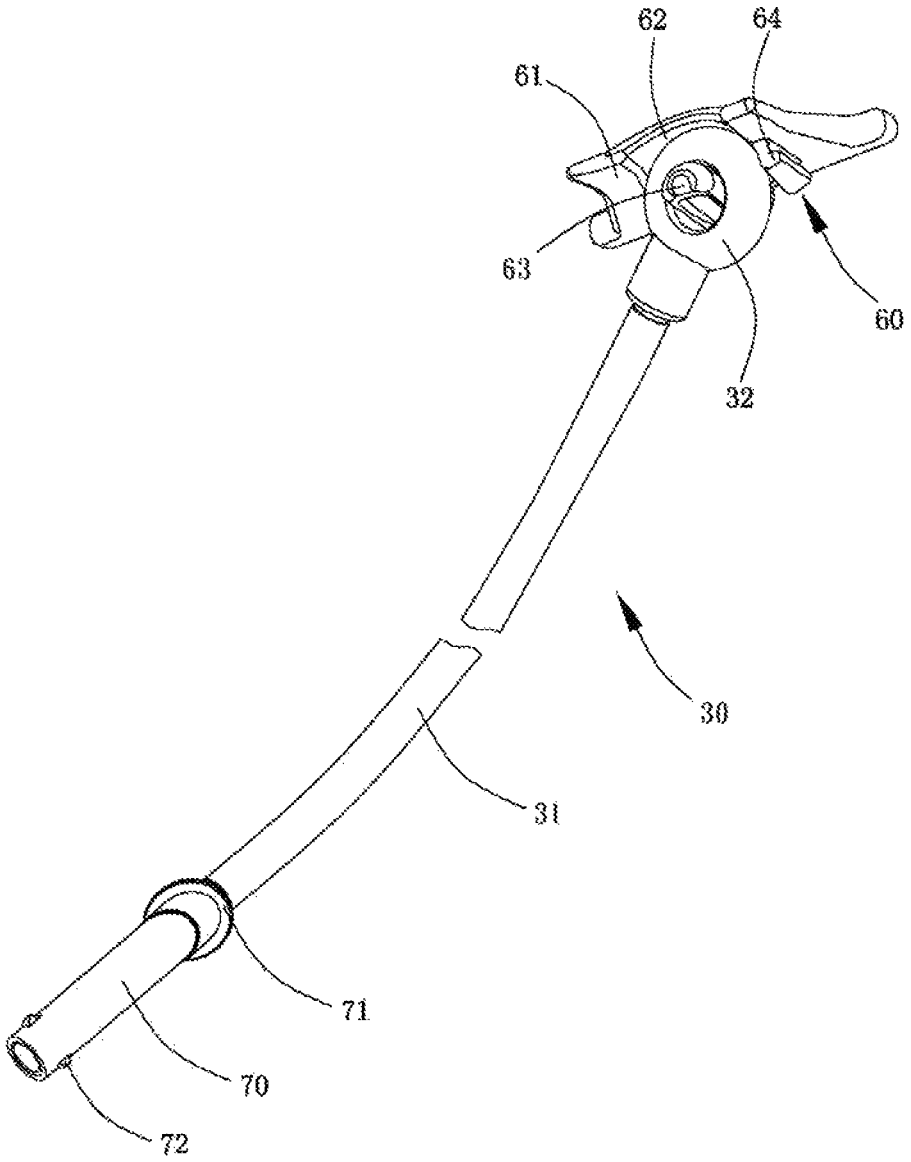
FIG. 5 shows the connection between the flexible rod, the buckle and the positioning tube.

Referring to FIGS. 1 to 5, the trampoline of the present invention comprises a chassis 10, a flexible cushion 20, multiple flexible rods 30, a protective net 40, multiple support rods 50 and multiple buckles 60. The flexible rods 30 are detachably connected to the chassis 10. The buckles 60 are connected to the flexible cushion 20. The flexible rods 30 are connected to the buckles 60 and expand the flexible cushion 20 which has a tension. The support rods 50 are detachably connected to the chassis 10. The protective net 40 has a lower end thereof connected to the flexible cushion 20, and a top end of the protective net 40 is connected to top ends of the support rods 50 so that a bounce space is formed between the protective net 40 and the flexible cushion 20.

In this embodiment, the trampoline is round, or other shapes such as rectangular or oval. The chassis 10 is made of Aluminum which is light in weight and benefit for transportation. The Aluminum has an oxide layer on the outer surface thereof so that no extra treatment is needed. Besides, Aluminum product is easily to be machined.

The chassis 10 comprises a base 11 and multiple support legs 12 connected to the base 11. The support legs 12 contact the floor or ground. The base 11 includes multiple installation tubes 13 which are detachably connected to each other to form the circular base 11. In this embodiment, there are six installation tubes 13 and each installation tube 13 is a curved and cylindrical tube. Each installation tube 13 includes multiple connection holes 131 defined axially therethrough. The connection holes 131 reinforce the strength of the installation tubes 13 and save material for the installation tubes 13.

The connection tubes 14 are inserted into the connection holes 131 and bolts secure the connection tubes 14 to the installation tubes 13 so that the installation tubes 13 are connected in sequence. In this embodiment there are two installation tubes 13 connected by one connection tube 14. Each of the installation tube 13 has multiple installation holes 132 and each installation hole 132 has a positioning tube 70 received therein. The bottom end of each of the flexible rods 30 and the support rods 50 are inserted into the positioning tubes 70 corresponding thereto, and the positioning tubes 70 reduces friction between the flexible rods 30, the support rods 50 and the installation tubes 13, so that the life of use of the flexible rods 30 and the support rods 50 is prolonged. The positioning tubes 70 each have a restriction portion 71 and a movable engaging portion 72, wherein the restriction portion 71 is located outside of the base 11 and the movable engaging portion 72 is located in the connection hole 131.

The support legs 12 each include a main frame 121 and a sub frame 121, wherein the main frame 121 has two ends respectively connected to the installation tubes 13, and the sub frame 122 has a lower end thereof detachably connected to the main frame 121. A top end of each sub frame 121 supports the connection portion between the installation tubes 13 to stably support the installation tubes 13. Specifically, the main frame 121 is a U-shaped frame and includes a transverse bar 123 and two upright bars 124 which are connected to two ends of the transverse bar 123 which contacts the floor or ground. The top end of each upright bar 124 is a straight section which is connected to the base 11. Each upright bar 124 includes an inclined section that is located opposite to the straight section to provide better support. The lower end of each sub frame 122 is detachably connected to the middle portion of the transverse bar 123. The sub frame 122 is rotatable 360 degrees about the transverse bar 123.

No welding process is needed to the connection between the base 11 and the support legs 12. Besides, each of the support legs 12 and the base 11 includes ridges extending axially from the outer surface to reinforce the strength and also provide friction. Other machining or treatment can be made to the outer surface of each of the support legs 12 and the base 11.

The flexible cushion 20 is made by woven material or heavy canvas, or both. The flexible cushion 20 has a flange 21 extending outward from the outer periphery thereof, and multiple restriction holes 211 are defined in the underside of the flange 21. The buckles 60 are connected to the restriction holes 211 and evenly located along the flexible cushion 20. The buckles 60 are made by plastic or metal, in this embodiment, the buckles 60 are made by Aluminum. Each buckle 60 has a main part 61, room 62 and a support portion 63, wherein the room 62 is defined in the underside of the main part 61, and the support portion 63 is located along the room 62 and extends into the room 62. The support portion 63 and the room 62 form an engaging portion.

The buckles 60 each have a hook 64 formed on the underside thereof, the hook 64 is located outside of the room 62 and faces a direction away from the room 62. The hooks 64 restrict the buckles 60 to prevent the flange 21 of the flexible cushion 20 from shifting, and the hooks 64 also restrict the flexible rods 30. When installing the buckles 60, the main part 61 is installed to the inner periphery of the flange 21, and the support portion 63 and the hook 64 protrude beyond the underside of the flange 21. The engaging portion includes an open end which faces the center of the base 11.

Each of the flexible rods 30 is a spiral rod and detachably connected to the frame 11. Each flexible rod 30 is a tubular body 31 which has the bottom end thereof positioned to the tube 70 corresponding thereto, and a ring 32 is formed on the top end of the tubular body 31. The ring 32 is located in the room 62 and the support portion 63 extends through the ring 32 which is engaged with the engaging portion. The support rods 50 each have a first rod 51, a second rod 52 and a connection member 53. The second rod 52 is detachably connected to the first rod 51 by the connection member 53. The protective net 40 has multiple sleeves 41 located on top portion thereof, and the top ends of the second rods 52 are inserted into the sleeves 41 to expand the protective net 40.

Because the multiple installation tubes 13, the support legs 12, the flexible rods 30 and the support rods 50 of the base 11 are detachable so that these parts can be easily packed and transported. The users can easily connect the installation tubes 13 to form the base 11, and the support legs 12 are then connected to the base 11. The flexible rods 30 are connected between the positioning tubes 70, and the rings 32 are engaged with the buckles 60. The flexible rods 30 are installed at an angle to expand the flexible cushion 20. The support rods 50 and the protective net 40 are then installed to obtain the trampoline. The trampoline can be dis-assembled by doing the steps mentioned above in reverse sequence.

The trampoline of the present invention has a simple structure and can be assembled easily. The Aluminum and assembled chassis 10, and the flexible rods 30 and the multiple support rods 50 make the trampoline be easily stored and transported. The cost of transportation and the storage space are reduced. The rings on the flexible rods and the buckles on the flexible cushion make the assembly of the trampoline become simple and easy. The flexible rods have higher support and resilient features so as to increase the bouncing features evenly. The trampoline of the present invention is useful and acceptable by users.

While we have shown and described the embodiment in accordance with the present invention, it should be clear to those skilled in the art that further embodiments may be made without departing from the scope of the present invention.

What is claimed is:

1. A trampoline comprising:

a chassis having a base and multiple support legs connected to the base, the base having multiple installation holes and each installation hole having a positioning tube received therein;

multiple flexible rods being spiral rods and detachably connected to the base, each flexible rod being a tubular body which has a bottom end thereof positioned to the positioning tube corresponding thereto, and a ring formed on a top end of the tubular body;

multiple buckles connected to an outer periphery of a flexible cushion, each buckle having a room and a support portion, the room defined in an underside of the buckle and the support portion located in the room, the ring is located in the room and the support portion extending through the ring;

a protective net having a lower end thereof connected to the flexible cushion, and multiple support rods each have a top end and a lower end, the lower end of each support rod connected to the positioning tube corresponding thereto, a top end of the protective net connected to the top ends of the support rods which expand the protective net, a bounce space being formed between the protective net and the flexible cushion.

2. The trampoline as claimed in claim 1, wherein the base includes multiple installation tubes and multiple connection tubes, the installation tubes being connected by the connection tubes to form the base.

3. The trampoline as claimed in claim 2, wherein the installation tubes each are a curve tube and have multiple connection holes, the connection tubes are connected to the connection holes.

4. The trampoline as claimed in claim 1, wherein the support legs each include a main frame which has two ends respectively connected to multiple installation tubes.

5. The trampoline as claimed in claim 4, wherein the support legs each include a sub frame which has a lower end detachably connected to the main frame, a top end of each sub frame supports a connection portion between the installation tubes.

6. The trampoline as claimed in claim 1, wherein the flexible cushion has a flange extending outward from an outer periphery thereof, multiple restriction holes are defined in an underside of the flange, the buckles are connected to the restriction holes.

7. The trampoline as claimed in claim 6, wherein the buckles each have a hook formed on the underside of the buckle thereof, the hook is located outside of the room and faces a direction away from the room.

8. The trampoline as claimed in claim 1, wherein the support rods each have a first rod, a second rod and a connection member, the second rod is detachably connected to the first rod by the connection member.

9. The trampoline as claimed in claim 1, wherein the positioning tubes each have a restriction portion and a movable engaging portion, the restriction portion is located outside of the base and the movable engaging portion is located in a connection hole.

10. The trampoline as claimed in claim 1, wherein the chassis is made of aluminum.

* * * * *